US006183223B1

(12) United States Patent
Yajima

(10) Patent No.: US 6,183,223 B1
(45) Date of Patent: Feb. 6, 2001

(54) CHEMICAL SUPPLY SYSTEM WITH A PAIR OF BELLOWS CONNECTED IN SERIES FOR PUMPING A FLUID

(75) Inventor: Takeo Yajima, Musashino (JP)

(73) Assignee: Koganei Corporation, Tokyo (JP)

( * ) Notice: Under 35 U.S.C. 154(b), the term of this patent shall be extended for 0 days.

(21) Appl. No.: 08/918,752

(22) Filed: Aug. 25, 1997

(30) Foreign Application Priority Data

Aug. 26, 1996 (JP) ..... 8-224186

(51) Int. Cl.[7] ..... F04B 43/08
(52) U.S. Cl. ..... 417/478
(58) Field of Search ..... 417/533, 383, 417/389, 478

(56) References Cited

U.S. PATENT DOCUMENTS 2,613,607 * 10/1952 Sheen et al. ..... 103/44

* cited by examiner

*Primary Examiner*—Charles G. Freay
*Assistant Examiner*—Robert Z. Evora
(74) *Attorney, Agent, or Firm*—McCormick, Paulding & Huber

(57) ABSTRACT

Connected to a flexible tube 13 which is expandable or shrinkable in the radial direction, are a flowpath 17 on the side of supply, which is provided therein with an on-off valve 21 on the side of supply, and a flowpath 19 on the side of discharge, which is provided therein with an on-off valve 22 on the side of discharge. A bellows 14 elastically deformable in the axial direction is disposed at the outside of the flexible tube 13. This bellows 14 has a small bellows portion 24 and a large bellows portion 25. An incompressible medium 43 is enclosed in a pump chamber 42 formed between the flexible tube 13 and the bellows 14. An operating disk portion disposed between the small bellows portion 24 and the large bellows portion 25 is displaced in the axial direction, whereby the inner volume of the bellows 14 is changed, so that the flexible tube 13 is expanded or shrunk in the radial direction to carry out the pumping operation. With this arrangement, a chemical supply system simplified in construction and excellent in reliability can be provided.

12 Claims, 8 Drawing Sheets

CHEMICAL SUPPLY SYSTEM WITH A PAIR OF BELLOWS CONNECTED IN SERIES FOR PUMPING A FLUID

BACKGROUND OF THE INVENTION

1. Field of the Invention

This invention relates to a chemical supply system adapted to discharge a predetermined quantity of a solution such as a chemical, and concerned with a chemical supply system suitable for use in coating a photo resist solution onto an outer surface of a semiconductor wafer, for example.

2. Related Art Statement

In manufacturing processes of various technical fields including a technique of manufacturing semiconductor wafers, a technique of manufacturing liquid crystal bases, a technique of manufacturing magnetic disks, a technique of manufacturing multilayer wiring bases and so forth, there have been used chemicals such as a photo resist solution, Spinion glass solution, a polyimide resin solution, pure water, a developing solution, an etching agent and an organic solvent.

For example, when the photo resist solution is coated onto the outer surface of the semiconductor wafer, the photo resist solution is dropped onto the outer surface of the semiconductor wafer in a state where the semiconductor wafer is rotated in a horizontal plane. As a chemical supply system used for coating the above-described photo resist solution, there has been used one, in which a pumping mechanism is obtained through an elastically deformable tube and bellows.

As the chemical supply system, in which the pumping mechanism is obtained through the bellows, such ones as shown in FIG. 8 have been developed for example. FIG. 8(A) shows a chemical supply system, in which a pump chamber 51 is formed at the outside of the bellows 50, and which is adapted to guide the chemical in a chemical tank 53 into the pump chamber 51 and to discharge the chemical from a coating nozzle 54 through expansion or shrinkage of the bellows 50 by a driving rod 52 assembled into the bellows 50. Furthermore, FIG. 8(B) shows a chemical supply system, in which an expandable or shrinkable flexible tube 55 is provided in a portion of a flowpath for connecting the chemical tank 53 to the coating nozzle 54, and a pressurizing chamber 56 provided in a tubular member disposed at the outside of the flexible tube 55 is connected to the pump chamber 51 disposed at the outside of the bellows 50.

In Patent laid-open No.29207/1993, there is disclosed a chemical supply system for coating the chemical by use of the flexible tube or flexible film similarly to FIG. 8 (B). In this system, the chemical is guided into the flexible film and incompressible fluid is subjected to the pumping operation by an actuator at the outside of the flexible film.

However, in the case where the bellows-type actuator is disposed at a position spaced apart from the flexible film and the incompressible fluid is supplied from the actuator to the exterior of the flexible film as described in this gazette, the system as a whole becomes large in size. Moreover, the system becomes complicated in construction, it is difficult to easily exchange parts positioned in portions being in contact with the chemical, it is uneasy to perform filling the incompressible fluid into the system, and it is uneasy to carry out the manufacturing work. Furthermore, it is difficult to control the incompressible fluid, and there may occur such a problem that, when leakage of the incompressible fluid occurs, the leakage cannot be easily detected and the system lacks the reliability.

Furthermore, in the case where the pumping operation of the chemical is directly performed by the bellows, the flow of the chemical does not occur at the rear end of the bellows 50, and moreover, since the outer surface of the bellows 50 is irregular as being concave or convex, there is a possibility of the chemical being stagnant in the pump chamber, so that the chemical may show a change in properties due to the stagnancy, to thereby serve as a cause of raising dust during the coating.

SUMMARY OF THE INVENTION

It is an object of the present invention to provide a chemical supply system simplified in construction and excellent in reliability.

The above-described and other objects, and novel feature of the present invention will become apparent more fully from the description of the following specification in conjunction with the accompanying drawings.

The following is a brief description of the outline of typical ones out of the inventions disclosed in the present application.

That is, the chemical supply system according to the present invention is characterized in that the system comprises: a bellows having a small bellows portion made of an elastic material and a large bellows portion made of an elastic material and larger in volume change per unit displacement value in the axial direction than the small bellows portion, and elastically deformable in the axial direction; a flowpath on the side of supply, which is connected between one end portion of said bellows and a chemical receiving portion and provided therein with an on-off valve on the side of supply; a flowpath on the side of discharge connected between the other portion of said bellows and a chemical discharging portion and provided therein with an on-off valve on the side of discharge; and a driving means for elastically deforming said bellows in the axial direction to shrink said small bellows portion and expand said large bellows portion, while, for elastically deforming said bellows in the axial direction to expand said small bellows portion and shrink said large bellows portion.

Furthermore, the chemical supply system according to the present invention is characterized in that the system comprises: a flexible tube made of an elastic material and expandable or shrinkable in the radial direction; a flowpath on the side of supply, which is connected between one end portion of said flexible tube and the chemical receiving portion and provided therein with the on-off valve on the side of supply; a flowpath on the side of discharge, which is connected between the other portion of said flexible tube and the chemical discharging portion and provided therein with the on-off valve on the side of discharge; and a bellows having the small bellows portion made of the elastic material and the large bellows portion made of the elastic material and larger in volume change per unit displacement value in the axial direction than the small bellows portion, disposed at the outside of said flexible tube and elastically deformable in the axial direction; an incompressible medium enclosed between said flexible tube and said bellows; and the driving means for elastically deforming said bellows in the axial direction to shrink said small bellows portion and expand said large bellows portion, while, for expanding said small bellows portion and shrinking said large bellows portion to thereby elastically deform said flexible tube in the radial direction.

Such an arrangement may be adopted that two said bellows are provided in parallel to each other, a small bellows portion of one of the bellows is disposed adjacently to a large bellows portion of the other of the bellows, and a large bellows portion of one of the bellows is disposed adjacently to a small bellows portion of the other of the bellows.

In the chemical supply system according to the present invention, the chemical is guided into the bellows having the small bellows portion and the large bellows portion and the pumping operation is performed by the expansion on shrinkage of the bellows in the axial direction, whereby the chemical flows through the bellows, so that, even if irregular surface, i.e., concave or convex surface is present on the inner surface of the bellows, stagnancy of the chemical can be prevented from occurring.

Furthermore, in the chemical supply system according to the present invention, the flexible tube is disposed in the bellows having the small bellows portion and the large bellows portion and expanding and shrinking operation of the bellows causes the flexible tube to be elastically deformed through the incompressible medium filled in a space formed between the bellows and the flexible tube, whereby the pumping operation by the bellows can be quickly transmitted to the flexible tube and the chemical is guided into the flexible tube having flat inner surfaces, so that stagnancy of the chemical in the flexible tube can be prevented from occurring.

DESCRIPTION OF THE PREFERRED EMBODIMENTS

Detailed description will hereunder be given of the embodiments of the present invention with reference to the drawings.

Figure 1:
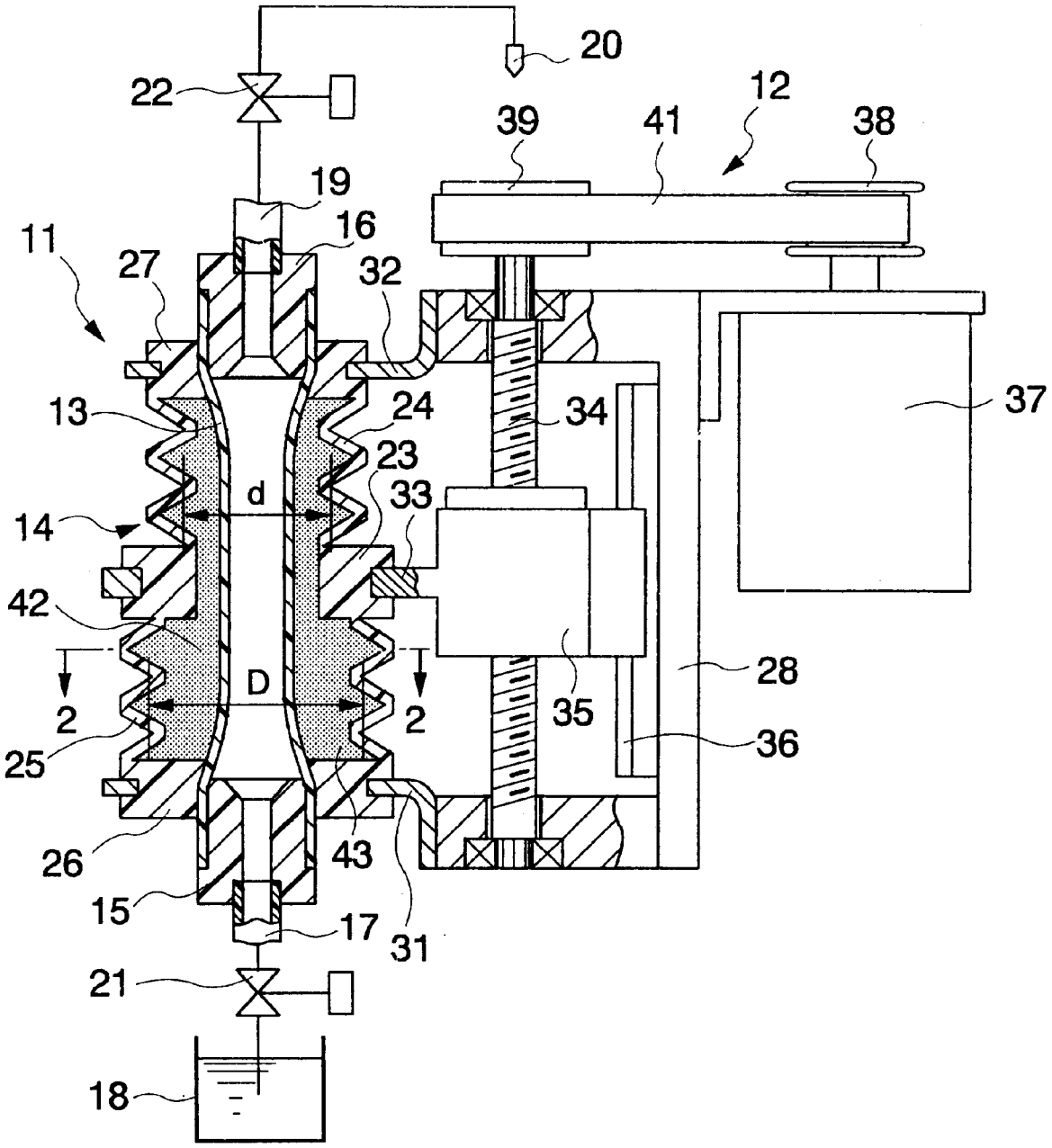
FIG. 1 is a partially cut-away front view showing a chemical supply system as being one embodiment of the present invention.
Figure 2:
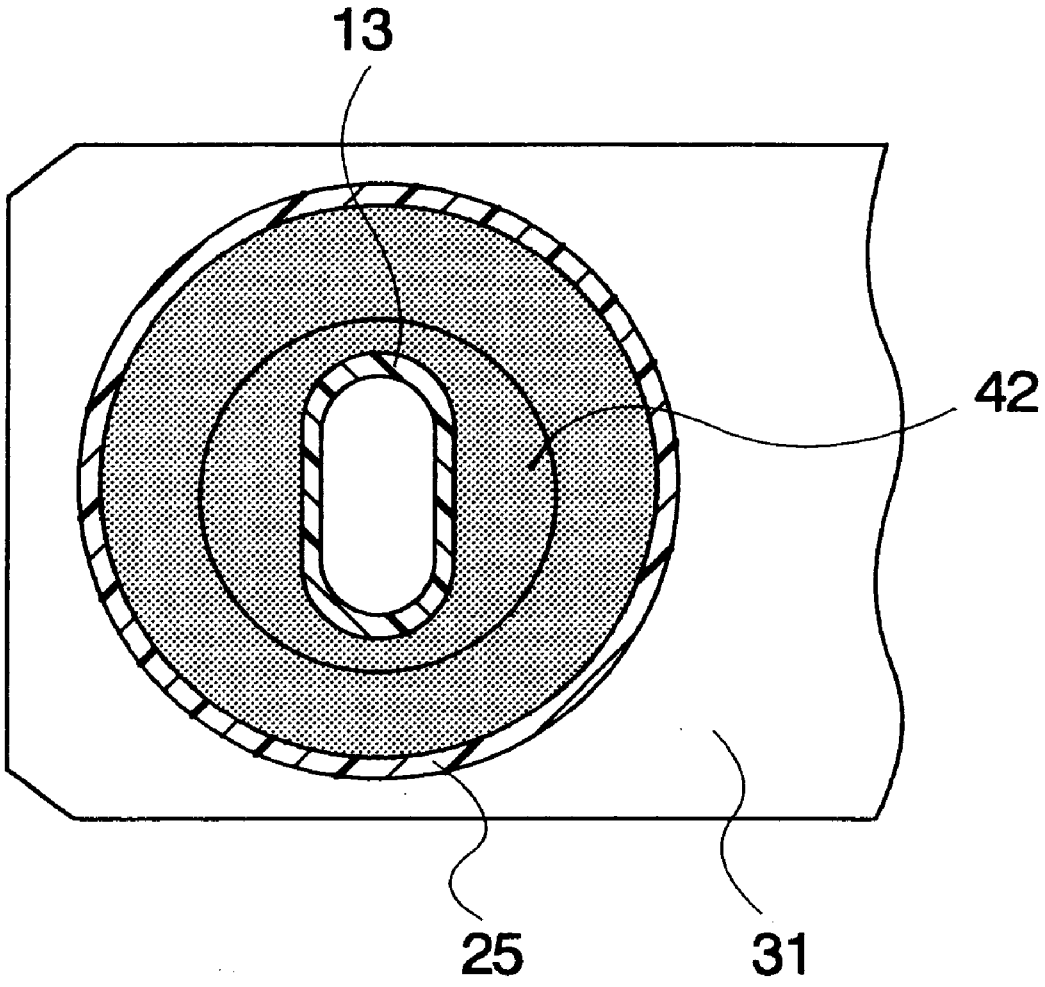
FIG. 2 is a sectional view taken along the line 2—2 in FIG.1, FIGS. 3(A) and 3(B) are sectional views showing the pumping operation of the bellows in the chemical supply system shown in FIG. 1.
Figure 3B:
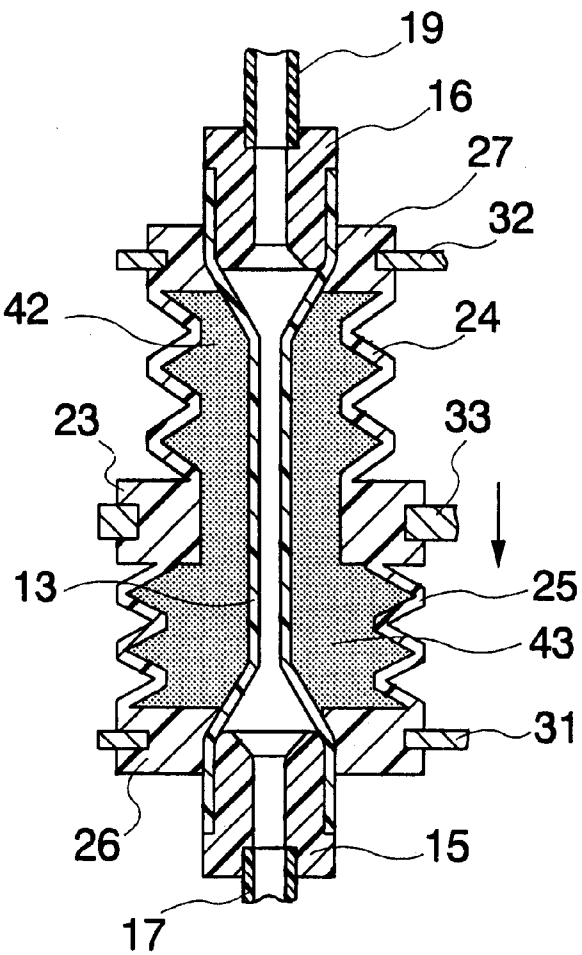
Figure 3A:
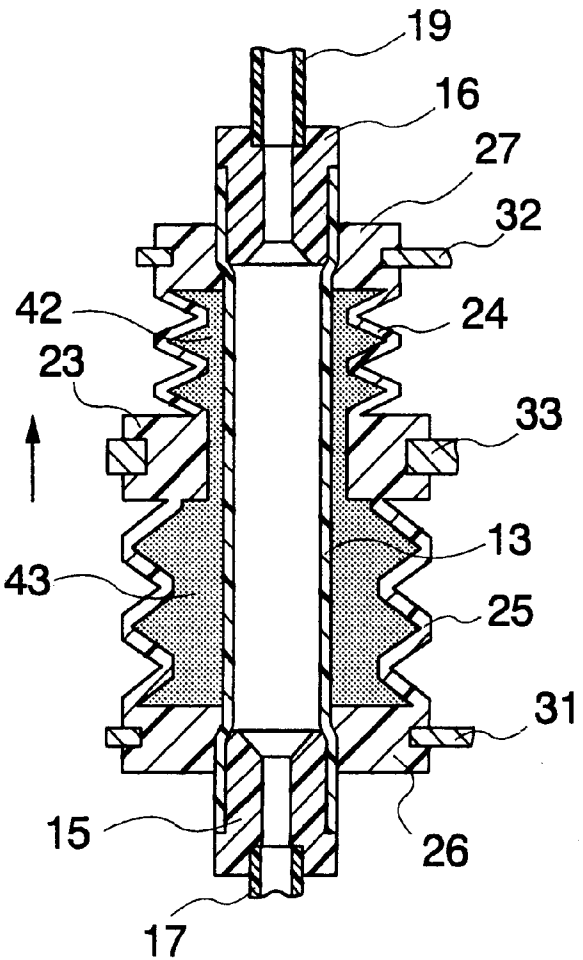

FIGS. 1 through 3 are the views showing a chemical supply system as being one embodiment of the present invention. This chemical supply system has a pump portion 11 and a pump driving portion 12, and the pump portion 11 includes a flexible tube 13 made of an elastic material and elastically expandable or shrinkable in the radial direction, and a bellows 14 disposed at the outside of the flexible tube 13, made of an elastic material and elastically deformable in the axial direction.

Adapter portions 15 and 16 are mounted to opposite end portions of the flexible tube 13, and, connected to one 15 of the adapter portions is a flowpath 17 on the side of supply, which is further connected to a chemical tank 18 as being a chemical receiving portion. Connected to the other 16 of the adapter portions is a flowpath 19 on the side of discharge, which is connected to a coating nozzle 20 as being a chemical discharging portion. Provided in the flowpath 17 on the side of supply is an on-off valve 21 on the side of supply for on-off operating this flowpath, and, provided in the flowpath 19 on the side of discharge is an on-off valve 22 on the side of discharge for on-off operating this flowpath. As the respective on-off valves 21 and 22, there may be used solenoid valves operated in response to an electric signal and air operating valves operated in response to air pressure, or, there may be further used check valves.

The bellows 14 includes an operating disk portion 23 disposed at the center in the axial direction, a small bellows portion 24 which is integral with the operating disk portion 23 and has an effective diameter d as shown in FIG. 1, and a large bellows portion 25 which is integral with the small bellows portion 24 through the operating disk portion 23 and has an effective diameter D larger than the effective diameter d of the small bellows portion 24. That is, the large bellows portion 25 has a sectional area larger than that of the small bellows portion 24. Here, the effective diameters d and D mean the average inner diameters of the respective small bellows portion 24 and large bellows portion 25 during the processes of expansion and shrinkage of the small bellows portion 24 and the large bellows portion 25. Fixed disk portions 26 and 27 are integral with opposite end portions of the bellows 14, the fixed disk portion 26 on the side of the large bellows portion 25 is fixed to the adapter portion 15 through the flexible tube 13 and the fixed disk portion 27 on the side of the small bellows portion 24 is fixed to the adapter portion 16 through the flexible tube 13.

Since the chemical to be supplied is a photo resist solution in the illustration, this flexible tube 13 is made of tetrafluoroethylene perfluoroalkyl vinyl ether copolymer (PFA) as being fluoroplastic in order not to react with the chemical, and the adapter portions 15 and 16 are made of the same material as described above. Furthermore, the bellows 14 is made of the same material, with the disk portion 23, 26 and 27 being integral with the bellows portion 24 and 25. However, as the resinous material, it is not limited to PFA, and, as far as the material is elastically deformable, any other resinous material may be used for the flexible tube 13 and the bellows 14. Furthermore, the flexible tube 13 and the bellows 14 may be made integral with each other, and, in this case, the adapter portions 15 and 16 can be dispensed with. Further, the bellows 14 may be made of metal.

The bellows 14 is secured to a support 28 through portion of the respective fixed disk portions 26 and 27, the fixed disk portion 26 is secured to the support 28 through a fixed bracket 31 which is assembled thereto, and the fixed disk portion 27 is secured to the support 28 through a fixed bracket 32 which is assembled thereto.

The bellows 14 is adapted to perform the pumping operation due to the axial displacement of the operating disk portion 23 disposed at the center in the axial direction. An operating bracket 33 assembled into the operating disk portion 23 is connected to a ball nut 35 threadably coupled to a ball screw shaft 34 extending in parallel to the bellows 14 and rotatably mounted to the support 28. The ball nut 35 is in sliding contact with a guide rail 36 provided on the support 28 and driven in the axial direction by the rotation of the ball screw shaft 34. In order to rotatably drive this ball screw shaft 34, a belt 41 is mounted between a pulley 38 fixed to a shaft of a motor 37 secured to the support 28 and a pulley 39 fixed to the ball screw shaft 34.

A space formed between the flexible tube 13 and the bellows 14 disposed at the outside of the flexible tube 13 is formed to provide a pump chamber 42, and this pump chamber 42 is filled up with an incompressible medium 43 such as liquid. Accordingly, if the bellows 14 is elastically deformed in the axial direction by use of the operating disk portion 23 disposed at the central portion of the bellows 14, then the volumes within the small bellows portion 24 and the large bellows portion 25 are changed, with the total length of the bellows 14 being not changed. With this arrangement, the flexible tube 13 is expanded or shrunk in the radial direction i.e., the lateral direction through the incompressible medium 43, so that the flexible tube 13 can carry out the pumping operation.

As shown in FIG. 2, the flexible tube 13 has an elliptic shape including circularly arcuate portions and flat portions, and, when the volume of the pump chamber 42 is changed, the flat portions are elastically deformed chiefly, whereby the flexible tube 13 is elastically deformed by a predetermined value in association with the change of the inner volume of the bellows 14. However, the flexible tube 13 may be made circular or any other odd shape in section.

FIG. 3 is the view showing the pump operation due to the axial displacement of the operating disk portion 23. As shown in FIG. 1, when the state where the operating disk portion 23 is disposed at about the center of the bellows 14 in the axial direction means the neutral state, if the operating disk portion 23 is displaced to the side of the small bellows portion 24 from this state by the motor 37, then the bellows 14 as a whole is shortened in a small diameter portion and lengthened in a large diameter portion, whereby the inner volume of the bellows 14 is increased. That is, the large bellows portion 25 is larger in the volume change per unit displacement value in the axial direction than the small bellows portion 24, whereby the volume in the bellows 14 is changed. With this arrangement, the flexible tube 13 is expanded in the radial direction, whereby the inner volume thereof becomes large, so that the chemical in the chemical tank 18 can be sucked into the flexible tube 13. At this time, the flow course of the flowpath 17 on the side of supply is opened by the operation of the on-off valve 21, and the flow course of the flowpath 19 on the side of discharge is closed by the operation of the on-off value 22 on the side of discharge.

On the other hand, if the operating disk portion 23 is displaced to the side of the large bellows portion 25, then the bellows 14 as a whole is shortened in the large diameter portion and lengthened in the small diameter portion, whereby the inner volume of the bellows 14 is decreased. With this arrangement, the flexible tube 13 is shrunk in the radial direction, whereby the inner volume thereof is decreased, so that the chemical in the flexible tube 13 can be discharged to the coating nozzle 20. At this time, the flow course of the flowpath 17 on the side of supply is closed by the operation of the on-off valve 21 on the side of supply, and the flow course of the flowpath 19 on the side of discharge is opened by the operation of the on-off valve 22 on the side of discharge.

Figure 8A:
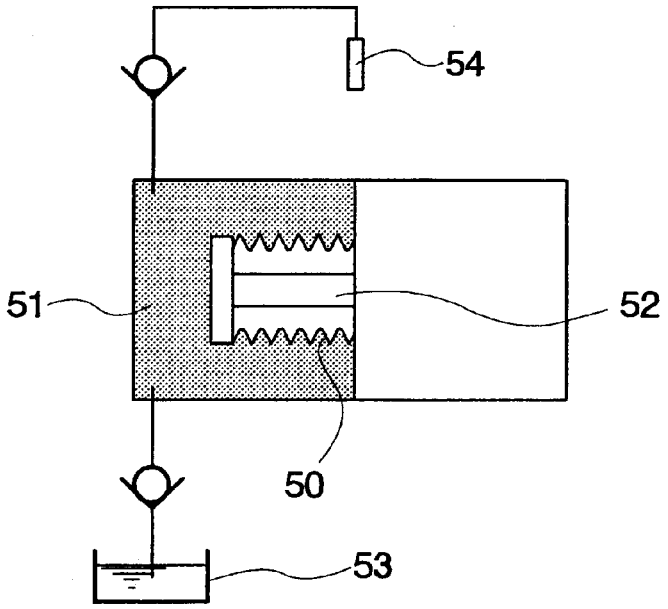
PRIOR ART Fig. 8(A)
FIGS. 8(A) and 8(B) are schematic diagrams showing the outlined constructions of the conventional chemical supply system, respectively.
Figure 8B:
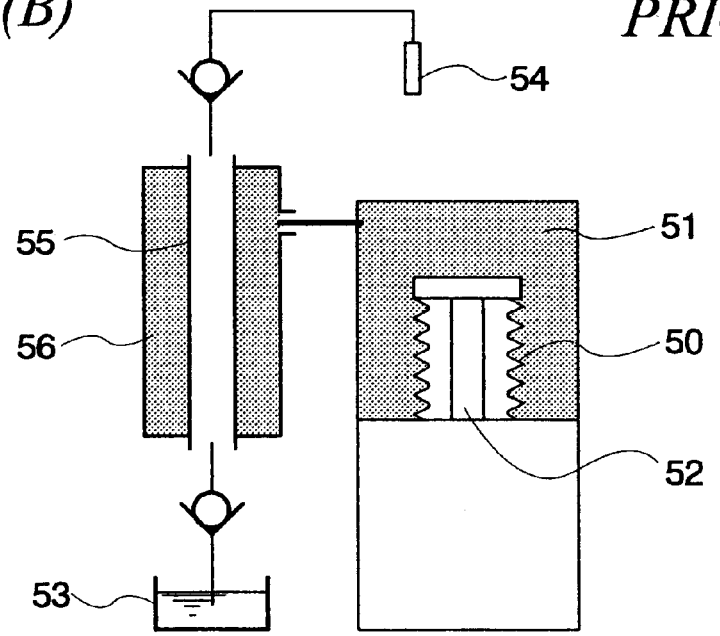
Fig. 8(B) PRIOR ART

During the above-described pumping operation, the bellows 14 is disposed at the outside of the flexible tube 13 through the incompressible medium 43, so that the volume change of the bellows 14 can be transmitted to the flexible tube 13 with high responsibility. As shown in FIG. 8(B), in a case where the medium is guided from the pump chamber 51 to a pressurizing chamber 56 disposed at the outside of a flexible tube 55 through a narrow flowpath, a constricted portion is present, whereby there is a delay time before the pumping operation is transmitted to the flexible tube 55. However, in the case as illustrated, the pumping operation can be carried out quickly without the above-described delay time.

There is such a case that, in order to prevent the chemical from dropping through the coating nozzle 20 after the chemical of a predetermined value is discharged through the coating nozzle 20, it becomes necessary to perform a suck-back operation. In this case, such a state is brought about that the on-off valve 21 on the side of supply is closed and the on-off valve 22 on the side of discharge is opened, the operating disk portion 23 is displaced to the side of the small bellows portion 24 and the flexible tube 13 is expanded. In the case where the above-described suck-back operation is performed, for the on-off valves 21 and 22, no check valve is used, and an electromagnetic valve to be on-off operated in response to an external signal or an air operating valve may be used.

As described above, in the illustrated chemical supply system, the bellows 14 is disposed at the outside of the flexible tube 13, so that the chemical supply system is simplified in construction and made compact in size and the required number of parts can be decreased. Furthermore, the incompressible medium 43 is filled in the space of the pump chamber 42 as formed between the flexible tube 13 and the bellows 14, so that the quantity of this incompressible medium 43 can be decreased.

When the pump chamber 42 is filled up with the incompressible medium 43, the space filled up with the medium 43 becomes simple in shape and the position of the presence of the medium is concentrated, so that the filing operation of the medium can be easily performed. In the conventional chemical supply system as shown in the above-described gazette and FIG. 8(B), the pressurizing chamber disposed at the outside of flexible tube is communicated with the pump chamber disposed at the out side of the bellows through the narrow flowpath, whereby the shape of the flowpath is complicated so that it is very difficult to pour the medium in, preventing the air from intruding. However, according to the present invention, the medium can be easily poured and filled in. If the air intrudes into the medium, then the associations between the lengthening and shrinking of the bellows 14 and the expanding and shrinking of the flexible tube 13 are not secured at high accuracy. However, according to the present invention, these associations can be secured at high accuracy, so that the discharging accuracy can be improved.

The pump chamber 42 has no filled space of the complicated shape and the position to be filled with the medium is concentrated, whereby the dangerous positions for leakage of the incompressible medium 43 are few, so that, even if this incompressible medium 43 leaks, the position of leakage can be easily detected and the leakage can be easily controlled. In short, the possibility of leakage is small in number and, in the event of leakage, it can be easily detected. In the past, the space of complicated shape is filled up with the medium, whereby the connected portions among the parts for forming the space are increased in number, so that, when the medium leaks, the positions of leakage cannot be found easily. However, according to the present invention, such troubles are avoided, so that the reliability of the system can be improved.

The flexible tube 13 is integral with the bellows 14, and these members are easily separated from the pump driving portion 12, so that these members can be easily exchanged with new ones. In short, in a case where the photo resist solution is discharged by the illustrated chemical supply system, when a substance changed in properties from the photo resist solution is attached to the inner surface of the flexible tube 13, it serves as the cause of raising dust, whereby it becomes necessary to exchange the wet parts contacting with the solution such as the flexible tube 13 periodically with new ones. In that case, in the conventional chemical supply system, the flexible tube is separated from the actuator portion, whereby it is not easy to exchange the flexible tube.

However, in the illustrated case, the work of exchange can be easily carried out.

Figure 4:
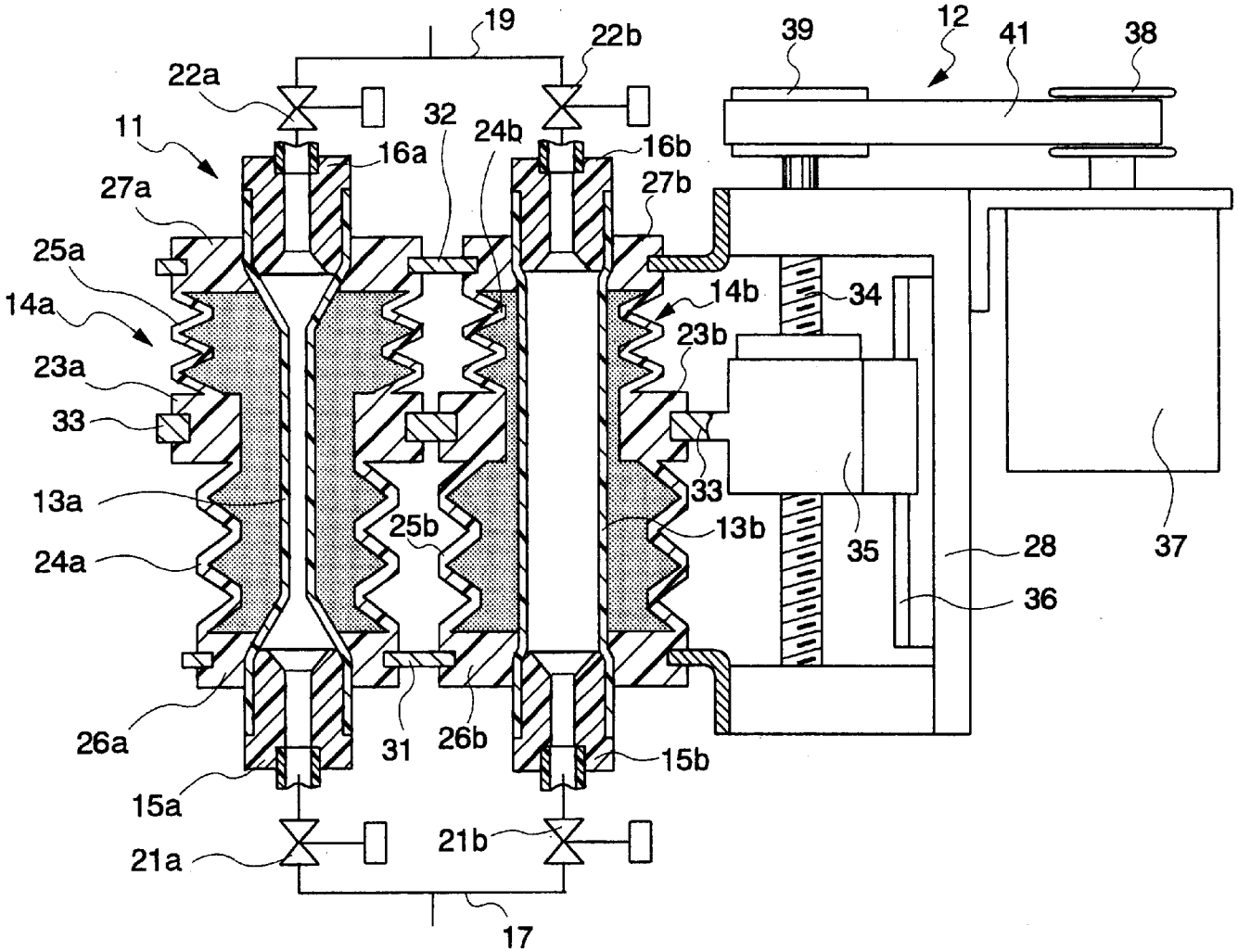
FIG. 4 is a partially cut-away front view showing the chemical supply system as being another embodiment of the present invention.

FIG. 4 shows the chemical supply system as being another embodiment of the present invention. In this case, the pump portion 11 includes two flexible tubes 13*a* and 13*b*, which are in parallel to each other, and two bellows 14*a* and 14*b*, which are disposed at the outside of the respective flexible tubes. Then, a small bellows portion 24*a* of one 14*a* of the bellows and a large bellows portion 25*b* of the other 14*b* of the bellows are positioned in the flowpath 17 on the side of supply, and a large bellows portion 25*a* of one 14*a* of the bellows and a small bellows portion 24*b* of the other 14*b* of the bellows are positioned in the flowpath 19 on the side of discharge. As described above, the construction of the pump driving portion 12 in this case is the same as that in the first embodiment except for that the two bellows 14*a* and 14*b* are in opposite directions to each other.

In this case, if respective operating disk portions 23*a* and 23*b* are displaced upwardly by the motor 37 in FIG. 4, in one 14*a* of the bellows, the large bellows portion 25*a* thereof is shrunk and the small bellows portion 24*a* thereof is expanded, and, in the other 14*b* of the bellows, the small bellows portion 24*b* thereof is shrunk and the large bellows portion 25*b* thereof is expanded, whereby one 13*a* of the flexible tubes is shrunk in the radial direction and the other 13*b* of the flexible tubes is expanded. With this arrangement, the pumping operation can be carried out at both times including the going time, during which the ball nut 35 moves in one of the straight linear direction, and the returning time, during which the ball nut 35 moves in the other of the straight linear direction, so that the chemical can be continuously discharged from the coating nozzle 20.

Figure 5A:
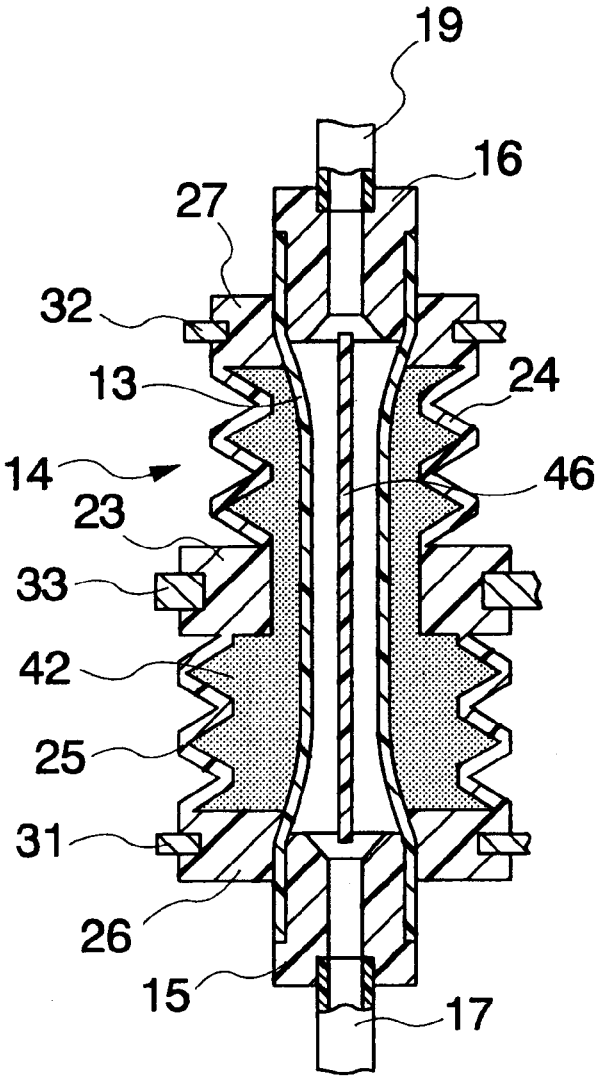
FIG. 5(A) is a sectional view showing the essential portions of the chemical supply system as being a further embodiment of the present invention, FIG. 5(B) being a sectional view of the flexible tube in FIG. 5(A), and FIG. 5(C) being a sectional view showing the flexible tube in a state of being shrunk in the radial direction.
Figure 5B:
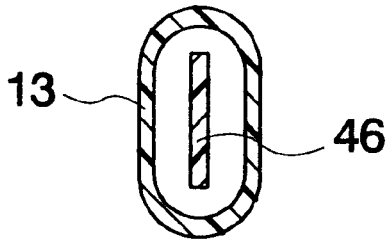
Figure 5C:
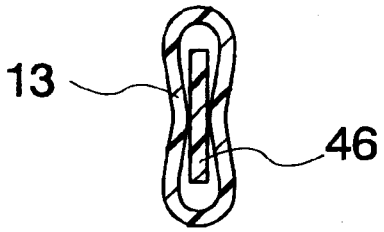

FIGS. 5(A) through 5(C) show the modified examples of the flexible tube 13 shown in FIG. 1. In this flexible tube 13, a belt-shaped stopper plate 46 made of the same material as the flexible tube 13 is disposed, whereby, when the volume of the pump chamber 42 is decreased, the flat portions of the flexible tube 13 came into contact with the stopper plate 46 as shown in FIG. 5(C), so that the circularly arcuate portions of the flexible tube 13 can be prevented from being squashed beyond necessity and the circularly arcuate portions can be prevented from being folded. The above-described stopper plate 46 is provided in accordance with the material quality of the flexible tube 13.

Figure 6A:
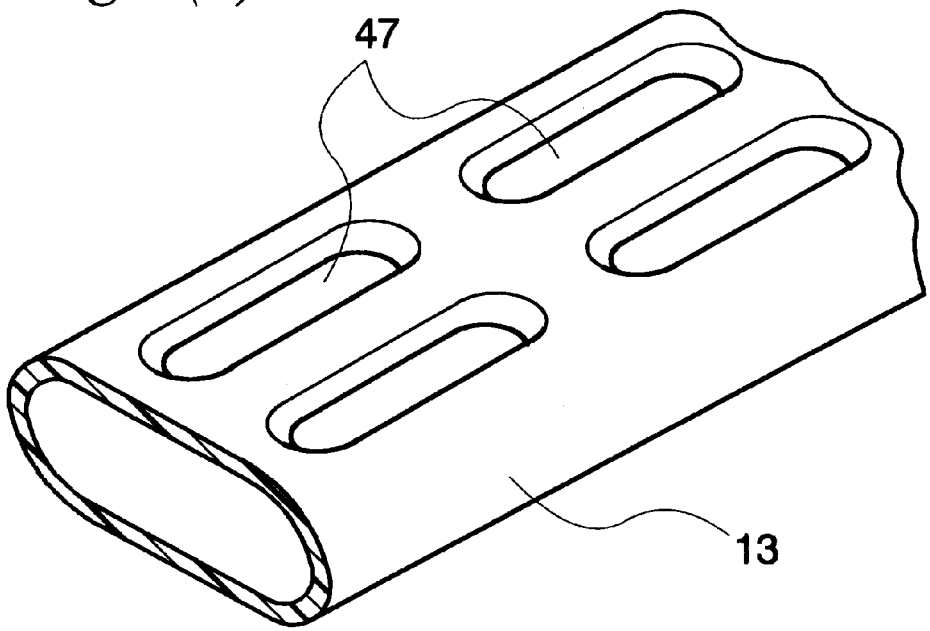
FIG. 6(A) is an oblique view showing a portion of a modified example of the flexible tube, FIG. 6(B) being a sectional view in FIG. 6(A), and FIG. 6(C) being a sectional view showing the flexible tube in a state of being shrunk in the radial direction.
Figure 6B:
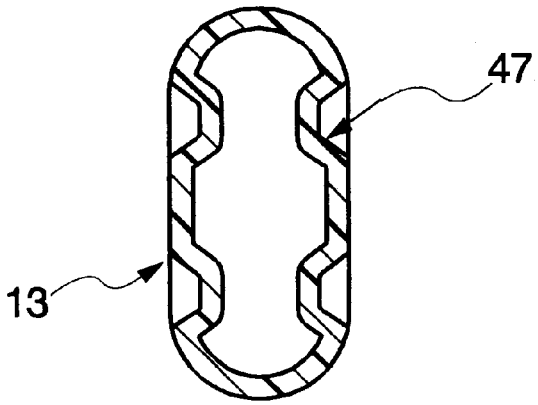
Figure 6C:
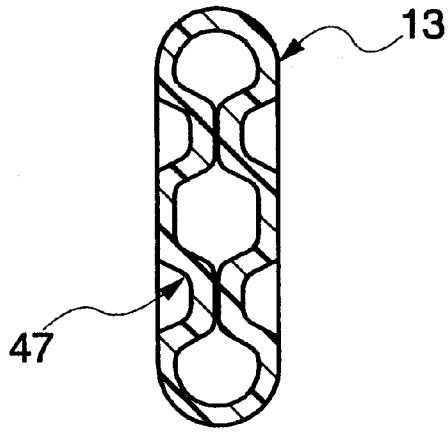

FIGS. 6(A) through 6(C) show other modified examples of the flexible tube 13. On the flat portions of this flexible tube 13, there are formed ridges 47 raised inwardly. When the flexible tube 13 is in a neutral state, the cross-section thereof is as shown in FIG. 6(B). However, when the flexible tube 13 is shrunk in the radial direction, the ridges 47 come into contact with each other as shown in the cross-sectional view of the flexible tube 13 in FIG. 6(C), thus preventing the circularly arcuate portions of the flexible tube 13 from being squashed.

The flexible tube 13 as shown in FIGS. 5 and 6 is applicable to the type of the chemical supply system shown in FIG. 1 and the type of the chemical supply system shown in FIG. 4.

Figure 7:
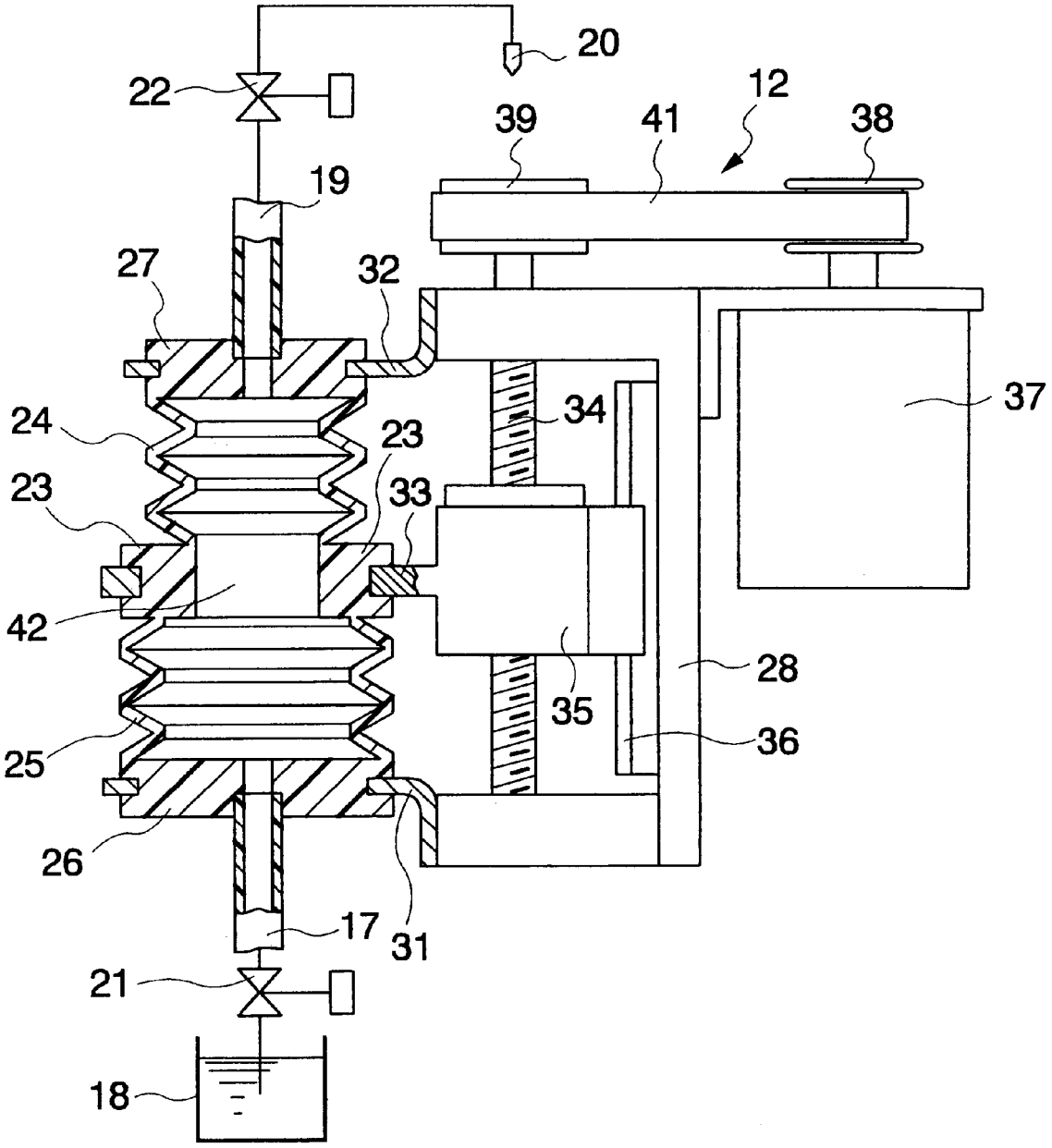
FIG. 7 is a partially cut-away front view showing the chemical supply system as being a still further embodiment of the present invention.

FIG. 7 is the view showing the chemical supply system as being the still further embodiment of the present invention. This chemical supply system corresponds to the chemical supply system excluding the flexible tube 13 in the chemical supply system shown in FIG. 1. Accordingly, connected to the fixed disk portion 26 of the bellows 14 is the flowpath 17 on the side of supply, which is communicated with the pump chamber 42 and, connected to the fixed disk portion 27 is the flowpath 19 on the side of discharge, which is communicated with the pump chamber 42, whereby the chemical flows through the bellows 14.

The chemical flows through the bellows 14 from one end to the other end, so that, even if the inner surface of the bellows 14 is irregular, occurrences of the stagnancy of the chemical are few and the chemical can be prevented from being changed in properties.

Even in this type of the chemical supply system, two bellows may be in opposite directions to each other.

Detailed description has hereinabove been given of the invention achieved by the present inventor with reference to the embodiments. However, the present invention should not be limited to the embodiments described above, and may be variously modified within the scope not departing from the gist.

For example, the present invention is applicable to the chemical supply systems for supplying various solutions except for coating the photo resist solution as illustrated. Furthermore, only if the lengths of the small bellows portion and the large bellows portion are changed with each other, with the total length of the bellows being not changed, such an arrangement may be adopted that the operating disk portion 23 is fixed and the fixed disk portions 26 and 27 are displaced in the axial direction in synchronism, whereby the pumping operation may be carried out. Further, in the illustrated embodiment, the operating disk portion 23 is driven in the axial direction by the motor 37 through the ball screw shaft 34. However, other driving means such as an air cylinder may be used. Then, as the incompressible medium, powder, granule and gel may be used other than liquid such as water, oil and the like.

The following is the brief description of the effects obtained by typical ones out of the inventions disclosed in the present application.

(1). Out of the bellows having the small bellows portion and the large bellows portion, the small bellows portion and the large bellows portion are displaced in the axial direction, whereby the inner volume of the bellows is expanded or shrunk to carry out the pumping operation, so that the chemical supply system simplified in construction can be obtained.

(2). The chemical flows through the pump chamber, so that, even if the inner surface of the bellows is irregular, occurrences of the stagnancy of the chemical are few and the chemical can be prevented from being changed in properties caused by the stagnancy.

(3). The flexible tube is disposed in the pump chamber and the flexible tube is expanded or shrunk to carry out the pumping operation, whereby, by the expansion or shrinkage of the inner volume of the flexible tube due to the displacement of the bellows in the axial direction, the flexible tube can be quickly operated through the incompressible medium, so that the chemical supply system excellent in responsibility can be obtained.

(4). The pump portion having the inner and outer double wall construction consisting of the flexible tube and the bellows disposed at the outside of the flexible tube is provided, whereby the chemical supply system can be made compact in size and have a simplified construction, so that the chemical supply system can be improved in reliability.

(5). The flexible tube can be easily exchanged, so that the maintenance of the chemical supply system can be easily carried out.

What is claimed is:

1. A chemical supply system comprising:

a flexible tube made of an elastic material and elastically expandable or shrinkable in the radial direction;

a flowpath through the bellows on a side of supply, which is connected between one end portion of said flexible tube and a chemical receiving portion and provided therein with an on-off valve on the side of supply;

a flowpath through the bellows on a side of discharge, which is connected between the other portion of said flexible tube and a chemical discharging portion and provided therein with an on-off valve on the side of discharge;

a bellows having a small bellows portion made of an elastic material connected in series to a large bellows portion made of an elastic material and larger in volume change per unit displacement value in the axial direction than said small bellows portion, disposed at the outside of said flexible tube and elastically deformable in an the axial direction;

an incompressible medium enclosed in a space formed between said flexible tube and said bellows; and a driving means mechanically connected to the bellows for elastically deforming said bellows in the axial direction to shrink said small bellows portion and expand said large bellows portion to thereby elastically expand said flexible tube in the radial direction, while, for expanding said small bellows portion and shrinking said large bellows portion to elastically shrink said flexible tube in the radial direction.

2. A chemical supply system as set forth in claim 1, wherein two of said bellows are disposed in parallel to each other, a small bellows portion of the first bellows and a large bellows portion of the second bellows are disposed adjacently to each other, a large bellows portion of the first bellows and a small bellows portion of the second bellows are disposed adjacently to each other, and said first and second bellows are simultaneously driven by said driving means to thereby supply a chemical continuously.

3. A chemical supply system as set forth in claim 1, wherein an effective diameter d of said small bellows portion is smaller than an effective diameter D of said large bellows portion.

4. A chemical supply system as set forth in claim 1, wherein said flexible tube includes an elliptic section having circularly arcuate portions and flat portions.

5. A chemical supply system as set forth in claim 4, wherein the flat portions of said flexible tube have ridges raised inwardly of said flexible tube.

6. A chemical supply system as set forth in claim 1, wherein said flexible tube is provided therein with a belt-shaped stopper member.

7. A chemical supply system as set forth in claim 6, wherein said stopper member is made of the same material as said flexible tube.

8. A chemical supply system as set forth in claim 1, wherein said flexible tube is made of fluoroplastic.

9. A chemical supply system comprising:

a bellows having a small bellows portion made of an elastic material connected in series to a large bellows portion made of an elastic material and larger in volume per unit displacement value in the axial direction than said small bellows portion, and elastically deformable in an axial direction;

a flowpath through the bellows on a side of supply, which is connected between one end portion of said bellows and a chemical receiving portion and provided therein with an on-off valve on the side of supply;

a flowpath through the bellows on a side of discharge, which is connected between the other end portion of said bellows and a chemical discharging portion and provided therein with an on-off valve on the side of discharge; and a driving means mechanically connected to the bellows for elastically deforming said bellows in the axial direction to shrink said small bellows portion and expand said large bellows portion, while, for elastically deforming said bellows to expand said small bellows portion and shrink said large bellows portion.

10. A chemical supply system as set forth in claim 9, wherein two of said bellows are disposed in parallel to each other, the small bellows portion of the first bellows and the large bellows portion of the second bellows are disposed adjacently to each other, and the large bellows portion of said first bellows and the small bellows portion of said second bellows are disposed adjacently to each other; and said first and second bellows are simultaneously driven by said driving means to thereby supply a chemical continuously.

11. A chemical supply system as set forth in claim 9, wherein an effective diameter d of said small bellows portion is smaller than an effective diameter D of said large bellows portion.

12. A chemical supply system as set forth in claim 9, wherein said bellows is made of fluoroplastic.

* * * * *